United States Patent [19]

Ma

[11] Patent Number: 4,697,606

[45] Date of Patent: Oct. 6, 1987

[54] CRANKED PATIO UMBRELLA FEATURING CRANKED TILT

[76] Inventor: Mark J. S. Ma, 12th Fl., 578 Kwang Fu S. Road, Taipei, Taiwan

[21] Appl. No.: 794,522

[22] Filed: Nov. 1, 1985

[51] Int. Cl.[4] ..... A45B 17/00

[52] U.S. Cl. ..... 135/20 M; 135/112; 135/DIG. 9

[58] Field of Search ..... 135/20 R, 20 M, 16, 135/21, 112, 900, 902, DIG. 9

[56] References Cited

U.S. PATENT DOCUMENTS

| | | | |
|---|---|---|---|
| 2,485,118 | 10/1949 | Simpson | 135/20 M |
| 2,503,032 | 4/1950 | Samelson | 135/20 M |
| 2,661,752 | 12/1953 | Kampe et al. | 135/20 M |
| 3,044,478 | 7/1962 | Russell | 135/20 M |
| 4,000,750 | 1/1977 | Becher | 135/16 |
| 4,132,236 | 1/1979 | Petersen et al. | 135/16 |

FOREIGN PATENT DOCUMENTS

| | | | |
|---|---|---|---|
| 128258 | 1/1932 | Fed. Rep. of Germany | 135/74 |

*Primary Examiner*—Robert A. Hafer
*Assistant Examiner*—D. Neal Muir
*Attorney, Agent, or Firm*—Gene W. Arant; Matthew F. Jodziewicz

[57] ABSTRACT

In an umbrella having a generally vertical two-part central shaft with a first fixed lower support post, and a second upper support post, which is pivotally attached to the upper end of the lower support post, an openable closeable umbrella cover carried by the upper end of the upper post, and a runner adapted to be driven upward along the lower support post and over the juncture of the two support posts onto the upper post for expanding the cover a drive gear tram is included for raising the runner and another second gear for tilting the upper support post relative to the lower support post including, also, a first gear rack extending from the juncture of the two support posts downward along the lower support post and is secured thereto. A second gear rack extends from the juncture upward along the upper post and is secured thereto. The two gear racks are substantially contiguous when the upper post is in vertical alignment with the lower post. A drive gear train is carried by the runner and cooperates with the gear racks for driving the runner upward. A second gear is carried by the lower support post proximate the juncture and is adapted to drivingly tilt the upper post relative to the lower post and to selectively retain the upper post in a tilted position. A removable operating handle is adapted to be selectively used to drive either the drive gear train or the second gear.

7 Claims, 7 Drawing Figures

CRANKED PATIO UMBRELLA FEATURING CRANKED TILT

BACKGROUND OF THE INVENTION

The conventional large umbrellas like the garden or beach umbrellas are often designed with a rocking handle fixed on the central rod to rotate and roll up one end of the pull cord with its other end connected by a guide wheel to the lower nest to make the lower nest, due to the tension of the pull cord, gradually move toward the upper end of the central rod so as to open the umbrella fabric, and also to drive the direction-bending device, thereby achieving the umbrella opening and the direction-bending object.

This conventional design to use the pull cord to pull the lower nest always has some defects and is unsuitable, for instance, when the rotary rocking handle makes the umbrella top open, as the downward pressure of the umbrella top and plurality of ribs often makes the pull cord connected between the lower nest and the rocking handle bear a very high pull force; further, when the lower nest makes the umbrella top open and continuously drives the direction-bending device, the decreased pressure makes the pull force of the pull cord immediately reduced, and unstable changes of the pull force of the pull cord cause the users many inconveniences during their rotating the rocking handle, or even the uneven pull force makes the pull cord to break or slip off from the guide wheel, or crisscrossly wind on the takeup spool, all of which constitute the unconquerable troubles to the conventional large umbrellas.

In the composition and assembly operations of the overall integral umbrellas the pull cord goes from the takeup spool on the one end of the rocking handle via the inner part of the central rod and the guide wheel and then is connected to the lower nest, and evidently the procedures are complicated and cannot be automated for manufacture; so the labor and indirect costs are relatively increased.

The invention serves to alleviate the said defects of the conventional large umbrellas to open the umbrellas by the pull cord windings and the direction-bending means, by providing a pull cordless umbrella top opening device that does not contain any components such as a guide wheel in connection with the pull cord or a take-up spool to roll up the pull cord; therefore, its overall construction is even more simplified by at least eliminating the above-said pull cord and its allied components, and even becoming simpler and faster to produce during the assembly operation, and the labor and indirect costs can thus be greatly lowered.

As this invention does not use a pull cord, unlike the conventional umbrellas, no problems such as easy breakages of the pull cord, slip-off of the pull cord from the guide wheel, and the crisscross windings of the pull cord will take place.

Another feature of the present invention is to provide that practically the rocking handle is used by the rotary way to drive the lower nest moving up to open the umbrella top, thus in its use, the internal change of the umbrella will not adversely affect the users' habit to employ the umbrella.

A further feature of this invention is to provide a drive rocking handle which can be removed from the central rod of the umbrella to select, use and open the umbrella top or to select the means to drive the numerous direction-bending umbrella structure, so this unfixed-type rocking handling achieves the simple, conveniente umbrella-opening actions and direction-bending actions.

Other features of this invention may be understandable from the following detailed description and the drawings.

DRAWING SUMMARY

FIG. 1 is an oblique view of a central shaft and corresponding mechanism constructed in accordance with the present invention;

FIG. 2*a*is a cross sectional view of the lower portion of the structure shown in FIG. 1;

FIG. 2*b*is a cross sectional view of the upper section of the structure shown in FIG. 1;

DETAILED DESCRIPTION

Figure 1:
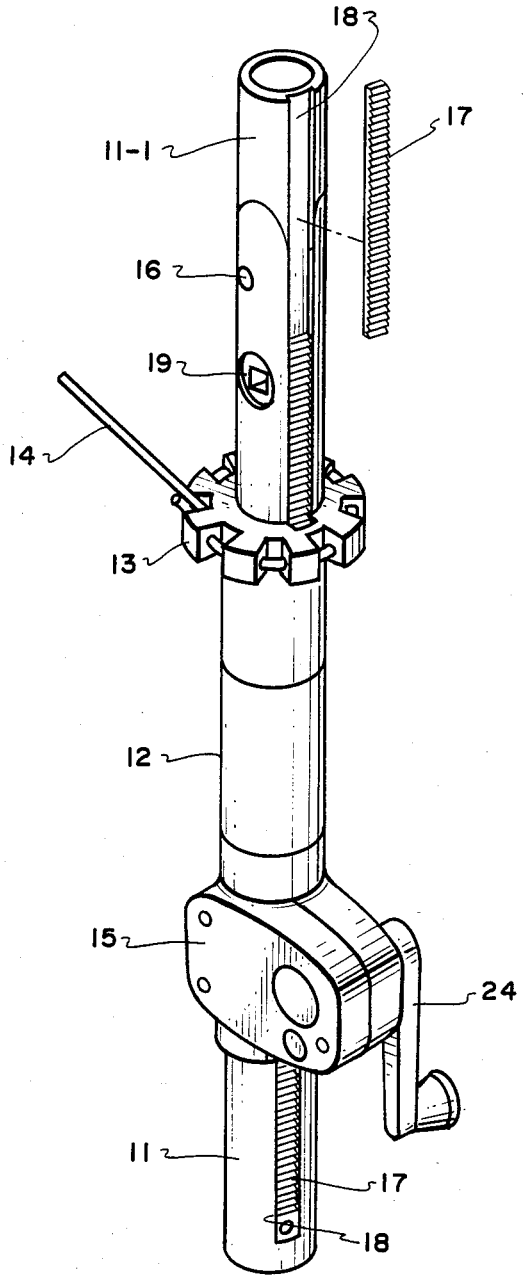
Figure 2A:
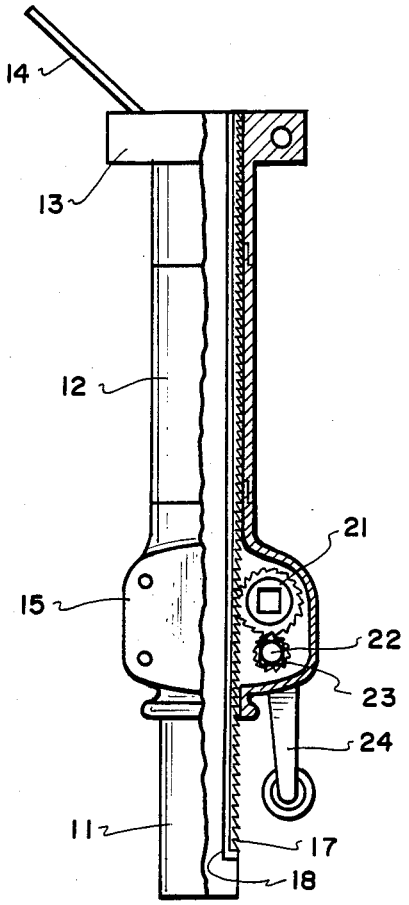
Figure 2B:
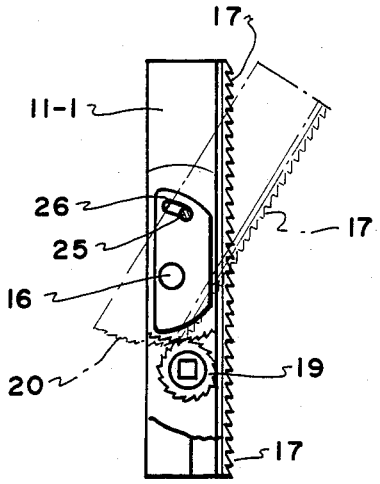

As shown in the accompanying FIGS. 1 & 2, the overall integral body of this invention comprises a runner or connection pipe 12 which slides on lower post 11. The upper end of pipe 12 is connected to the lower nest 13, which is attached with a plurality of ribs 14 (only one rib is shown in the drawings) to support the umbrella top (not shown), and the lower end of 12 is connected with slidable housing 15 inside which an umbrella-opening gear 21 is installed to make the lower nest 13, the hollow connection pipe 12 and the slidable part 15 form an integral connection.

The central rod or lower post 11 is connected by a plug pin 16 to the upper post or section 11-1 of the central rod, and the direction bending part of the central rod is formed on the said connection part. On the outer rim on one side of the central rod 11 there is an upper lengthwise rabbet slot 18 to receive a gear rack or spline 17. A pair of the splines 17 can just go through this direction-bending part to be inserted upwardly and downwardly into the inner part of the rabbet slot 18 in the central rod 11 and the upper section 11-1 of the central rod 11, a strong bond or locking screw is used to secure the spline 17 on the central rod. (In FIG. 1, a part of the spline in the upper section 11-1 of the central rod has been disassembled to show the inner side more clearly.) When the upper post 11-1 and lower post 11 are in vertical alignment, the gear racks 17 are substantially contiguous.

On the central rod 11 close to the direction-bending part, a direction-bending gear 19 concealed in the inner part of the central rod is provided, the gear face of the gear 19 just engages with the gear face 20 provided on the bottommost rim of the upper section 11-1 of the central rod 11, the rotation of the direction-bending gear 19 makes the upper section 11-1 of the central rod 11 tilt (as the tilt state shown in FIG. 2) the tilt angle is formed into an angular fixation by the positioning pin 25 provided on the top of the central rod 11 and the arcuate positioning slot 26 provided in the upper section 11-1 of the central rod 11.

Figure 3:
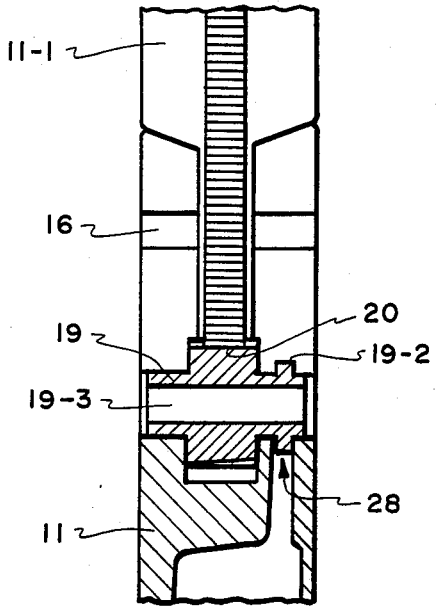
FIG. 3 is a cross sectional view showing how the tilting mechanism of the structure shown in FIG. 1 engages for activation.
Figure 4:
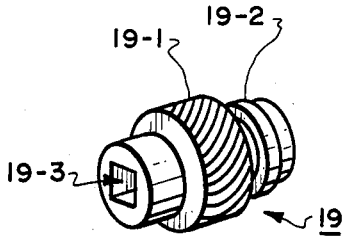
FIG. 4 is a perspective, isolated view of the gear wheel used to tilt the central shaft of the structure shown in FIG. 1.

Viewed from another angle, see FIGS. 3 and 4, the direction-bending part and the direction-bending gear 19 is set in the hollow inner part of the central rod 11 and also comprises a helical gear face 19-1 to just engage with the gear face 20 on the bottom most rim of the upper section 11-1 of the central rod 11. On one side of the gear face 19-1, a fixing convex ring 19-2 is provided to just match the slot 28 in the inner side of the central rod 11 for positioning, the said gear 19 is also provided with a non-circular hollow axial central part 19-3 (in this example, a hollow square axial center is shown as a representative), the rocking handle 24 is set in this central part 19-3 to drive and rotate this gear 19. Thereby achieving the direction-bending object.

Figure 6:
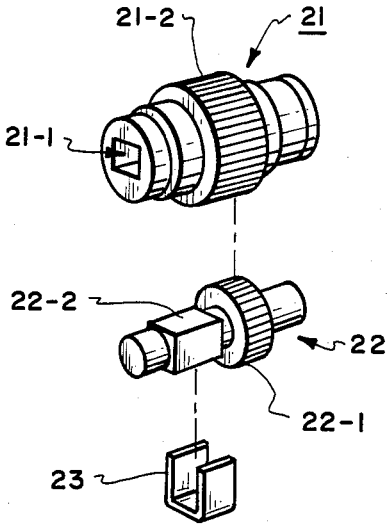
FIG. 6 is a perspective, exploded and isolated view of the elevation gear train and locking mechanism of the present invention as shown in FIG. 1.

Further, as shown in FIG. 2, in the inner portion of the slidable part 15, an umbrella-opening gear 21 which can engage with the spline 17, and a brake gear 22 which can engage with the umbrella-opening gear 21 in another angle, and a U-shaped (or double-clamp-plate-type) brake element 23 with a elasticity which is fixed on the inner side shell body of the slidable part 15, thus constituting the integral construction of the drive slidable part 15 and movable up and down in the lower nest. Enlarged tri-dimensional views of the umbrella-opening gear 21, brake gear 22 and brake element 23 are shown in FIG. 6. Just like the above-said direction-bending gear 19, the umbrella-opening gear 21 comprises a non-circular hollow spindle hole 21-1 with the same specification, and a gear face 21-2 to engage with the spline 17; the brake gear 22 comprises a gear face 21-1 to engage with the gear face 22-2 to be clamped by the U-shaped brake element 23.

Figure 5:
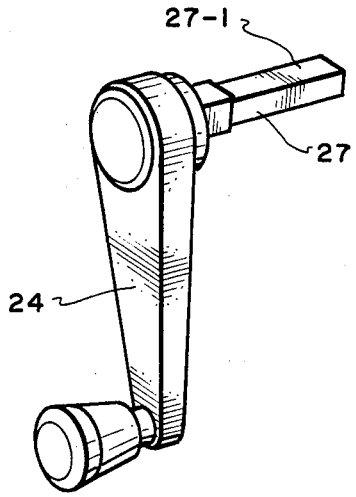
FIG. 5 is a perspective, isolated view of the crank handle of the present invention.

The rocking handle 24 is a non-fixed component, and as shown in FIG. 5, the rocking handle 24 comprises a drive non-circular axial part 27 which can just be inserted into the above-said hollow spindle hole 21-1 to drive the umbrella-opening gear 21 or to be set into the above-said hollow spindle hole 19-3 with the same specification to drive the direction-bending gear 19. At a proper position on this rocking handle 24, a connection chain with a proper length (not shown) can also be provided to connect the slidable part 15 to avoid the slip-off and loss of the rocking handle without adversely affecting the opening of the umbrella top.

The above-said umbrella-opening gear 21 and the brake gear 22 provided in the inner portion of the slidable part 15 are all designed to be firmly supported by the outer shell body of the slidable housing 15 and a hollow axial hole aligned with 21-1 is exposed in one side or two opposite sides of the said outer shell body to receive the spindle 27 of the rocking handle to be inserted therein, or on the said spindle 27, an elastic steel ball 27-1 is provided to make the rocking handle inserted in the axial hole not get off therefrom any way.

As shown in FIG. 1, when the spindle 27 of the rocking handle 24 is set into spindle hole on one side of the slidable part 15 (or the other side), (with only one side shown in this example), when the rocking handle 27 is rotated, because in its inner part, the umbrella-opening gear 21 and the spline 17 mutually engage to gradually move up, the lower nest 13 can thus drive the umbrella ribs 14 to open umbrella top, until the slidable part 15 moves up and passes over the direction-bending part to fully open the umbrella top. Now, the square axial section 22-2 of the brake gear 22 is clamped by the brake element 23 to use the clamping brake force to make the umbrella-opening gear 21 fixed.

After the rocking handle 24 is drawn out, the spindle 27 of the rocking handle is set into the spindle hole 19-3 of the direction-bending gear 19. The rotation of the rocking handle makes the upper post or section 11-1 of the central rod tilt to achieve the object of its overall tilt. The reverse rotational action of the same rocking handle can make the direction-bending return to its upright position and the slidable part 15 gradually move down along the central rod to achieve the object of folding and packing up the umbrella.

In addition to the above-said feature described in the examples, this invention can still make other changes and modifications to increase the applicable power of the umbrella, for instance, the direction-bending gear 19 can also be exposed with two hollow spindle holes in the outer rims on the two symmetric sides of the central rod to receive the spindle of the rocking handle without affected by the directions; or alternatively the direction-bending gear is set into the inner part of the central rod in another angle as a change to merely expose one spindle hole located on the other side rim of the central rod symmetrical to the spline 17, which will never adversely affect the entire operation.

What I claim is:

1. In an umbrella having a generally vertical fixed lower support post with an upper and a lower end, an upper support post with an upper and a lower end which is pivotally attached to the upper end of said lower support post, a foldable umbrella cover carried by the upper end of said upper post, and a runner adapted to be driven upward along said lower post and over the juncture of said two posts onto said upper post for expanding said cover, improved means devoid of a pull cord for drivingly raising said runner and also for tilting said upper post relative to said lower post, said improved means comprising, in combination:

a first gear rack extending from said juncture downward along said lower post and secured thereto;

a second gear rack extending from said juncture upward along said upper post and secured thereto, said two gear racks being substantially contiguous when said upper post is in vertical alignment with said lower post;

gear wheel means carried by said runner and cooperating with said gear racks for driving said runner upward;

gear means carried by the lower support post proximate said juncture and adapted to drivingly tilt said upper post relative to said lower post and to selectively retain said upper post in said tilted position; and a removable operating handle adapted to be selectively used to drive either said gear wheel means or said gear means.

2. In an umbrella having a generally vertical lower support, an upper support post pivotally attached at a first end to a first end of the lower support post, thereby forming an aligned central shaft, a foldable umbrella cover adapted to open and close carried by an opposite second end of the upper support post and mounted on the central shaft by means of a runner encircling the central shaft and adapted to be driven parallel to a longitudinal axis of the central shaft across the juncture of the lower and upper support posts for opening and closing the umbrella cover, improved means for selectively moving the runner along the central shaft to open and close the umbrella cover and also for tilting the upper support post relative to the lower support post, said improved means comprising, in combination:

a first gear track secured to the lower support post and oriented generally parallel to the longitudinal axis of the central shaft and extending from the juncture of the upper and lower support posts downward;

a second gear track secured to the upper support post and oriented generally parallel to the longitudinal axis of the central shaft and extending from the juncture of the upper and lower support posts upward, said first and second gear tracks being substantially contiguous when the upper support post is in vertical alignment with the lower support post;

first gear means carried by the runner and cooperating with said first and second gear tracks for moving the runner along said first and second gear tracks along the central shaft;

second gear means carried by the lower support post proximate the juncture of the upper and lower support posts cooperating with a mating third gear track secured to the upper support post adapted to selectively tilt the upper support post relative to the lower support post;

securement means associated between the upper and lower support posts for selectively retaining, in an adjustable manner, the upper support post in said tilted position;

a removable operating handle adapted to be selectively used to actuate said first and second gear means.

3. The improvement in an umbrella as recited in claim 2, wherein the first gear means comprises a first gear wheel having its gear teeth matingly engaged with said first and second gear tracks and adapted to be rotated by said operating handle.

4. The improvement in an umbrella as recited in claim 3, wherein the second gear means comprises a second gear wheel having its gear teeth matingly engaged with said third gear track and adapted to be rotated by said operating handle.

5. The improvement in an umbrella as recited in claim 4 wherein the securement means comprises a slot formed in the end of the lower support post proximate the juncture of the upper and lower support posts and adapted to slidably receive therein a pin projecting from the upper support post proximate the juncture of the upper and lower support posts for limiting the angle through which the upper support post may tilt in relation to the lower support post.

6. The improvement in an umbrella as recited in claim 5 further including an adjustable braking means operatively coupled with said first gear means for selectively retaining in an adjustable and releasable manner the position of the runner along said first and second gear tracks.

7. The improvement in an umbrella as recited in claim 6 wherein said braking means comprises a locking gear wheel matingly cooperating with said first gear wheel and adapted to selectively prevent rotation of said first gear wheel.

* * * * *